US009732577B2

(12) United States Patent
Holland, Jr. et al.

(10) Patent No.: US 9,732,577 B2
(45) Date of Patent: Aug. 15, 2017

(54) BLOWOUT PREVENTER WITH HINGED BONNET

(71) Applicant: Axon EP, Inc., Houston, TX (US)

(72) Inventors: William Rinehart Holland, Jr., Spring, TX (US); Jess W. Shows, Houston, TX (US); Bradford S. Franks, Alvin, TX (US)

(73) Assignee: Axon Pressure Products, Inc., Houston, TX (US)

( * ) Notice: Subject to any disclaimer, the term of this patent is extended or adjusted under 35 U.S.C. 154(b) by 0 days.

(21) Appl. No.: 14/847,192

(22) Filed: Sep. 8, 2015

(65) Prior Publication Data

US 2017/0067309 A1 Mar. 9, 2017

(51) Int. Cl.
*E21B 33/06* (2006.01)

(52) U.S. Cl.
CPC ..... *E21B 33/063* (2013.01); *E21B 33/062* (2013.01)

(58) Field of Classification Search
CPC ..... E21B 33/06; E21B 33/061; E21B 33/062; E21B 33/063
USPC ..... 251/1.1, 1.2, 1.3; 166/85.1, 85.4
See application file for complete search history.

(56) References Cited

U.S. PATENT DOCUMENTS 3,658,287 A * 4/1972 Lerouax ..... E21B 33/062 166/92.1
5,255,890 A * 10/1993 Morrill ..... E21B 33/062 251/1.3
5,638,855 A * 6/1997 Morrill ..... E21B 33/062 137/15.18
5,647,572 A 7/1997 Morrill
5,975,484 A * 11/1999 Brugman ..... E21B 33/062 251/1.1
6,969,042 B2 * 11/2005 Gaydos ..... E21B 33/063 251/1.1
8,408,514 B2 4/2013 Yadav
8,978,751 B2 * 3/2015 Castriotta ..... E21B 33/062 166/364

* cited by examiner

*Primary Examiner* — John K Fristoe, Jr.
*Assistant Examiner* — Andrew J Rost
(74) *Attorney, Agent, or Firm* — Baker Botts L.L.P.

(57) ABSTRACT

The disclosed embodiments are directed to a blowout preventer with a hinged bonnet assembly having components designed to improve the maintenance and serviceability of the blowout preventer. The blowout preventer includes a body with intersecting passageways extending therethrough. The blowout preventer also includes a bonnet including a ram unit capable of seating in a ram location of the body and a bonnet door removably coupled to a first side of the body. The blowout preventer further includes a pin or hinge adapter disposed along the body and defining a hinge axis, and a hinge rotatably coupled to the pin or hinge adapter. The hinge is coupled to the bonnet door to rotate the bonnet about the hinge axis, and the hinge and the bonnet door are selectively separable. The separable hinge allows an operator to access, remove, and replace the hinge if the hinge becomes worn or impacted during operation.

14 Claims, 9 Drawing Sheets

BLOWOUT PREVENTER WITH HINGED BONNET

TECHNICAL FIELD

Embodiments of the present disclosure relate generally to blowout preventers, and more specifically, to an improved hinged bonnet for use in a blowout preventer ram unit.

BACKGROUND

Blowout preventers are used extensively throughout the oil and gas industry in order to prevent undesirable fluid flow from the wellbore through the wellhead. The two categories of blowout preventers that are most prevalent are ram blowout preventers and annular blowout preventers. Blowout preventer stacks frequently utilize both types, typically with at least one annular blowout preventer stacked above several ram blowout preventers. Accordingly, typical blowout preventers may include a main body to which various types of ram units may be attached. The ram units in ram blowout preventers allow for both the shearing of the drill pipe and the sealing of the blowout preventer. Typically, a blowout preventer stack may be secured to a wellhead and may provide a safe means for sealing the well in the event of a system failure.

In a typical blowout preventer, a ram bonnet assembly may be attached to the main body using a number of high tensile bolts or studs. The bolts or studs are positioned through a flange of the bonnet assembly to couple the bonnet assembly to the body. In some blowout preventers, the bonnet assembly can include a bonnet door that is hinged to the body. This allows the bonnet assembly to be held in a desired position relative to the body while the bolts or studs are connected. In addition, the hinged bonnet assembly allows for easy access to the inside of the ram unit. It is desirable to provide a hinged bonnet assembly that enables easy maintenance for parts of the blowout preventer that might become worn or damaged.

SUMMARY

The present disclosure relates to an improved blowout preventer. More particularly, in certain embodiments, the present disclosure relates to an improved hinged bonnet for use in a blowout preventer ram unit and other improvements.

In one embodiment, the present disclosure provides a blowout preventer including a body defining intersecting horizontal and vertical passageways extending through the body. The blowout preventer also includes a bonnet including a ram unit capable of seating in the ram location of the body and a bonnet door removably coupled to a first side of the body. The blowout preventer further includes a pin or hinge adapter disposed along the body and defining a hinge axis, and a hinge rotatably coupled to the hinge adapter. The hinge is coupled to the bonnet door to rotate the bonnet about the hinge axis, and the hinge and the bonnet door are selectively separable.

In another embodiment, the present disclosure provides a system including a bonnet door and a hinge. The bonnet door includes a flanged portion for removably coupling a bonnet having the bonnet door to a body of a blowout preventer. The hinge is coupled to the bonnet door for rotating the bonnet about a hinge axis relative to a hinge adapter disposed on the body. The hinge and the bonnet door are selectively separable while the bonnet door is coupled to the body of the blowout preventer.

In a further embodiment, the present disclosure provides a method including routing hydraulic fluid from a hinge adapter coupled to a body of a blowout preventer into a hinge of the blowout preventer and from the hinge into a bonnet door that is bolted to the body and fluidly coupled to the hinge. The method also includes routing the hydraulic fluid through flowpaths in the bonnet door to actuate a cylinder disposed in a bonnet having the bonnet door. The method further includes selectively removing the hinge from the bonnet door while the bonnet door remains bolted to the body of the blowout preventer.

The features and advantages of the present invention will be readily apparent to those skilled in the art. While numerous changes may be made by those skilled in the art, such changes are within the spirit of the invention.

BRIEF DESCRIPTION OF THE DRAWINGS

A more complete and thorough understanding of the present embodiments and advantages thereof may be acquired by referring to the following description taken in conjunction with the accompanying drawings.

DETAILED DESCRIPTION

The present disclosure relates to an improved blowout preventer. More particularly, in certain embodiments, the present disclosure relates to an improved blowout preventer comprising a metal-to-metal seal and other improvements.

Generally, embodiments of the disclosure are directed to a blowout preventer with a hinged bonnet assembly having components designed to improve the maintenance and serviceability of the blowout preventer. Existing blowout preventers with hinged bonnet assemblies typically include a body and a bonnet door that is hinged (i.e., rotatably coupled via a pin or adapter) to the body. Often the portion of the bonnet door that hinges to the body is positioned such that it sticks out from the body of the blowout preventer. In this position, the hinged portion is susceptible to impact from other equipment, which can damage this portion of the bonnet door. Since the bonnet door often includes specially designed internal hydraulic fluid pathways for routing fluid to operate the ram unit, the bonnet door cannot be welded to repair the damaged portion of the door. Instead, the bonnet door must be removed from the body and replaced with another door. Furthermore, at times, the pin (or adapter) that the bonnet door is attached to can become worn out, requiring replacement. This can involve removing the entire bonnet door along with the pin. The process of removing the bonnet door can take an undesirable amount of time and energy, since several bolts may have to be removed from the bonnet door and the body.

The disclosed blowout preventer includes a hinged bonnet assembly designed to address the drawbacks associated with existing blowout preventers. The disclosed blowout preventer generally includes a bonnet assembly having a bonnet door and a hinge for rotatably coupling the bonnet door to a hinge adapter disposed along a body of the blowout preventer. The hinge is selectively separable from the bonnet door such that the hinge can be disconnected from the bonnet door while the bonnet door remains coupled to a side of the body of the blowout preventer. The separable hinge may allow an operator to access, remove, and replace the hinge if the hinge becomes worn or impacted during operation. In addition, the hinge may be selectively removed to provide access to a pin or hinge adapter component coupled to the body. The hinge may be removed from the bonnet door faster than the bonnet door can be removed from the body, thereby decreasing the time required to perform maintenance on certain portions of the blowout preventer.

Figure 1A:
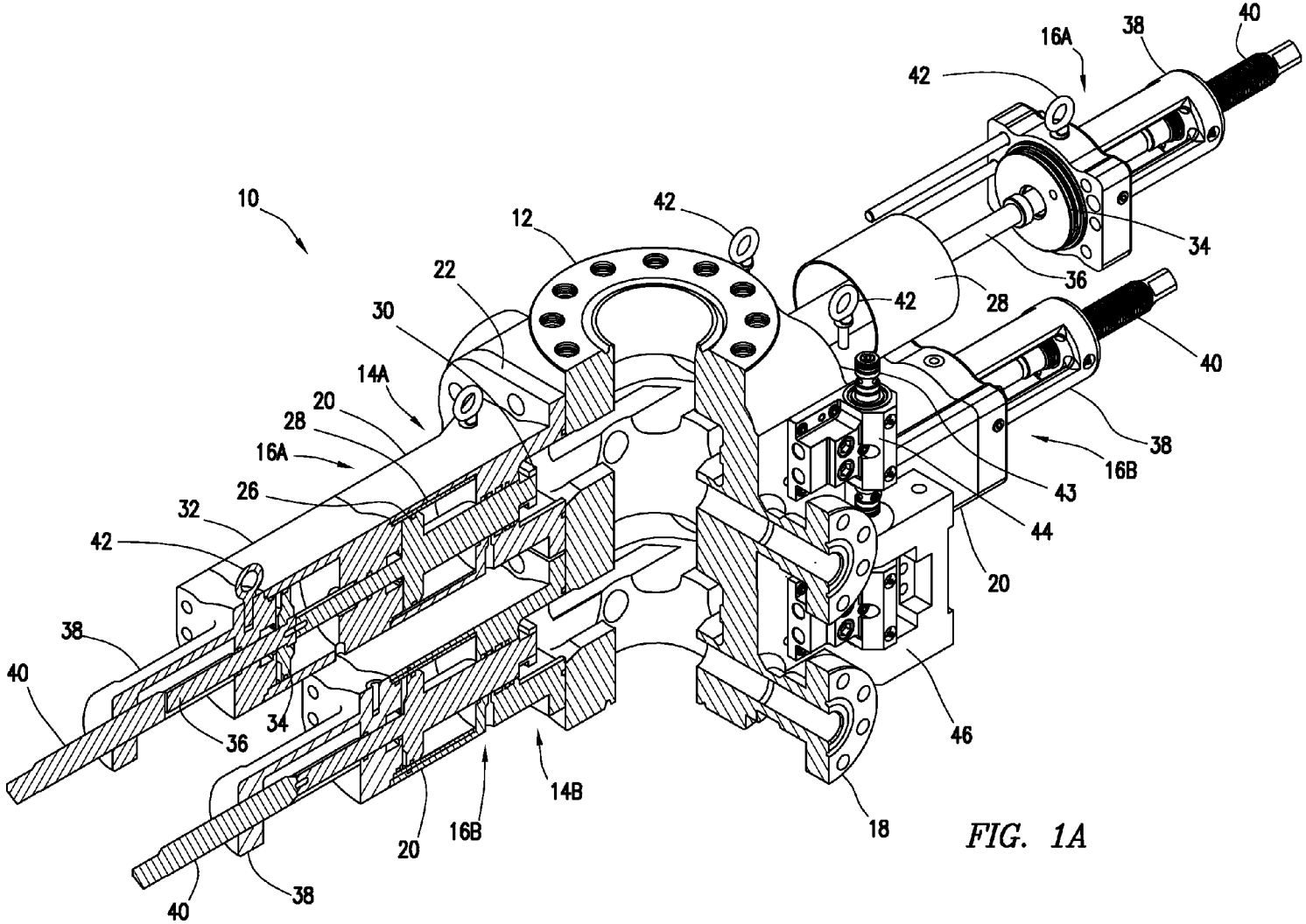
FIGS. 1A and 1B are partial cutaway and side views of a blowout preventer including a hinge for coupling a bonnet door to a hinge adapter, in accordance with an embodiment of the present disclosure.
Figure 1B:
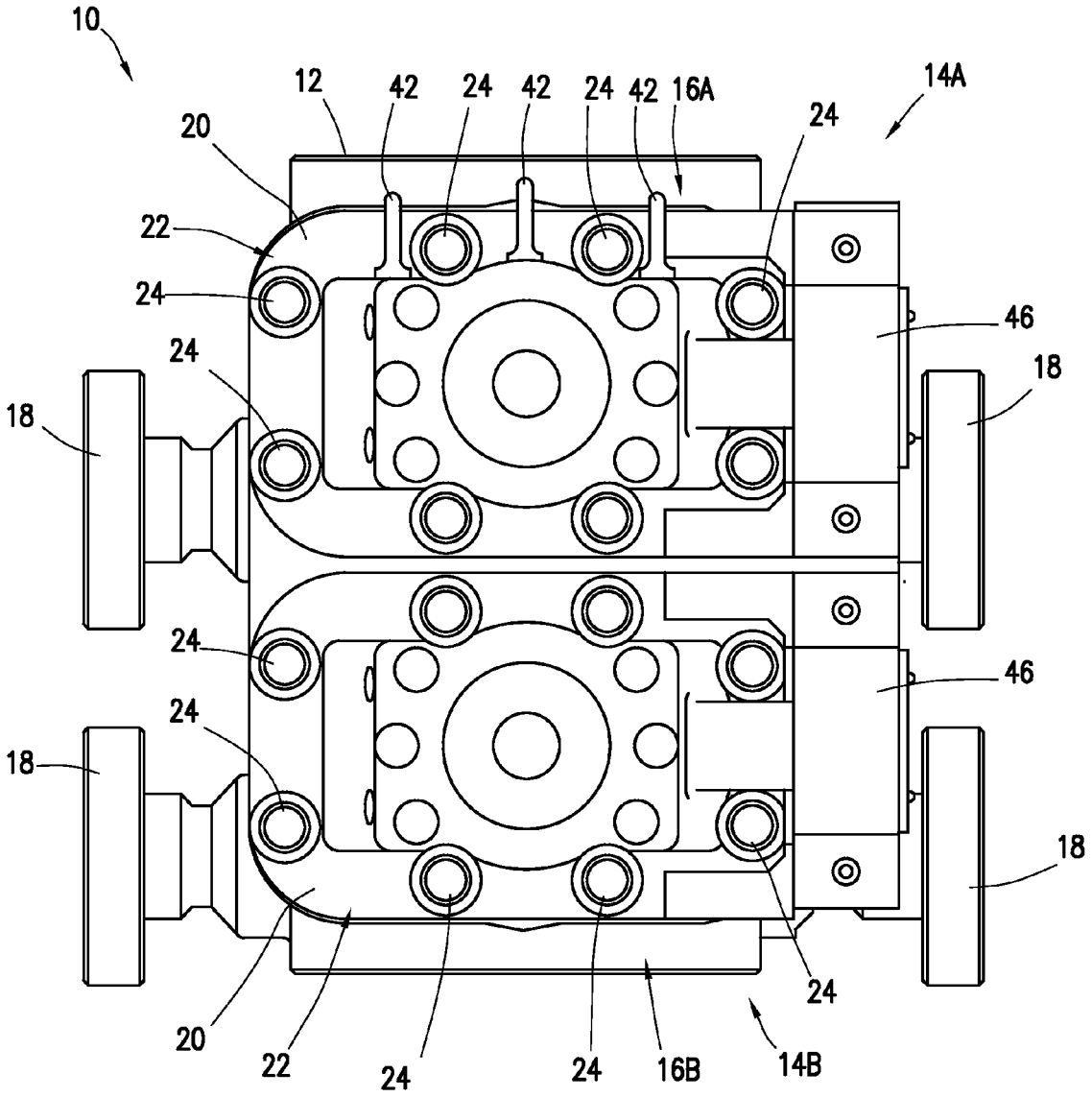

Turning now to the drawings, FIGS. 1A and 1B illustrate a partial cutaway perspective view and a side view of a blowout preventer 10 in accordance with the disclosed techniques. The blowout preventer 10 may include, among other things, a body 12 and two ram units 14. In certain embodiments, the body 12 may encompass all the operational features of a blowout preventer with regard to bore and ram feature operation.

The body 12 includes bores that define intersecting horizontal and vertical passageways extending through the body 12. Specifically, in the illustrated embodiment, the body 12 includes one vertical passageway intersected by two horizontal passageways. Each horizontal passageway forms a ram location for a corresponding one of the two ram units 14. Although two ram units 14A and 14B are shown in a stacked arrangement in the illustrated embodiment, it should be noted that other embodiments of the blowout preventer 10 may be designed with fewer or more ram units 14 being utilized with the body 12 to shear and seal a tubular element.

Each ram unit 14 may include two opposing shear blades (not shown) designed to be actuated together via one or more actuation components of the ram unit 14 to shear a wellbore tubular and seal the blowout preventer 10. The wellbore tubular (not shown) may be generally positioned between the shear blades of the blowout preventer, extending through the vertical passageway of the body 12. The wellbore tubular may be a joint or string of drill pipe, casing, production tubing, or some other tubular component extending into a wellbore formed through a subterranean formation. During normal drilling, completion, and production operations at a well site, the shear blades may be held in open positions separated from one another to allow the wellbore tubular to pass through the blowout preventer 10. In the event of a system failure downhole, the blowout preventer 10 may actuate the shear blades toward each other and into shearing engagement with the wellbore tubular. This may cause the ram units 14 to close and seal the wellbore tubular.

Each ram unit 14 may include two distinct bonnet assemblies 16 disposed on opposite sides of the body 12 of the blowout preventer 10. For example, in the illustrated embodiment, the ram unit 14A includes the two corresponding bonnet assemblies 16A, while the ram unit 14B includes the two corresponding bonnet assemblies 16B. In each ram unit 14, the bonnet assemblies 16 are designed to actuate and bring the shear blades of the blowout preventer 10 together through the horizontal passageway in the body 12 to shear the wellbore tubular and seal the blowout preventer 10.

As shown, the blowout preventer 10 may also include outlets 18 extending from the body 12 in transverse directions from the corresponding bonnet assemblies 16. The outlets 18 may be disposed at opposite ends of another set of horizontal passageways formed through the body 12.

In certain embodiments, the bonnet assemblies 16 may be specifically designed to satisfy the operation requirements of the BOP with regard to operating pressure and design forces required to shear and seal the wellbore tubular. Each bonnet assembly 16 generally includes a bonnet door 20 removably coupled to one side of the body 12. As illustrated, each bonnet door 20 may include a flanged portion 22 coupled to the body 12 via bolts 24, for example.

The bonnet door 20 may generally function as a housing for an actuation component of the bonnet assembly 16. For example, the bonnet door 20 may define an internal chamber that acts as a hydraulic cylinder. The bonnet assembly 16 may also include an operating piston (and shaft) 26 and a cylinder liner 28 disposed within the hydraulic cylinder of the bonnet door 20. A ram block adapter 30 may be disposed at the end of the operating shaft 26 extending toward the body 12. This ram block adapter 30 may be used to couple the shaft 26 to one of the shear blades for the particular ram unit 14.

Hydraulic fluid flowpaths (not shown) may be formed in the bonnet door 20 to direct hydraulic fluid from a source to the cylinder chamber on each end of the operating piston 26. Hydraulic fluid may be routed to one side of the piston 26 or the other to actuate the piston 26 in a direction toward or away from the body 12. For example, when it is desirable to shear and seal a wellbore tubular in the blowout preventer 10, the bonnet door 20 may route hydraulic fluid into a side of the piston chamber facing away from the body 12, while routing fluid away from the side of the piston chamber closer to the body 12. The change in hydraulic pressure within the chamber may force the operating piston and shaft 26 toward and into the horizontal passageway of the body 12, where the shear blade connected to the adapter 30 can help shear the wellbore tubular. Reversing the flow of hydraulic fluid through the bonnet door 20 may reverse the actuation of the piston 26 to reopen the shear blocks of the ram unit 14.

In some embodiments, one or more of the blowout preventer ram units 14 may include a booster cylinder 32 added to the bonnet assembly 16. A booster piston 34 and booster shaft 36 may be disposed in the booster cylinder 32 to provide auxiliary power for closing the ram unit 14. As shown in FIG. 1A, the ram unit 14A includes a booster cylinder 32 disposed on the outwardly extending end of the bonnet door 20. The ram unit 14B, however, may include just the operating cylinder assembly disposed in the bonnet door 20, without an additional cylinder. As described below, the booster cylinder 32 (along with the piston 34 and shaft 36) may provide additional mechanical closing force to the bonnet assembly 16 for closing the ram unit 14 against a wellbore tubular.

An end cap 38 and locking screw 40 may be disposed over the end of each bonnet assembly 16, regardless of whether the particular bonnet assembly 16 includes a booster cylinder 32 or just the bonnet door 20. The end cap 38 may define an outer wall of the cylindrical chamber of the bonnet door 20 or the booster cylinder 32, as shown. In some embodiments, the blowout preventer 10 may include one or more lifting eyes 42 disposed at various lift points along an upper surface of the blowout preventer 10.

In the disclosed embodiments, the bonnet assemblies 16 are hinged to the body 12 of the blowout preventer 10. Specifically, the blowout preventer 10 may include a pin 43 disposed along and coupled to the body 12. In the illustrated embodiment, a hinge adapter 44 is coupled directly to the body 12, and the pin 43 is disposed through the hinge adapter 44. As shown, the hinge adapter 44 and the pin 43 extend along the body 12 to define a longitudinal hinge axis. It should be noted that other embodiments of the blowout preventer 10 may have other arrangements for coupling a hinge 46 to the body 12, such as just a pin 43 (without an adapter) disposed along and coupled to the body 12, or integral with the body 12.

The disclosed blowout preventer 10 also includes a hinge 46 rotatably coupled to the body 12 via the pin 43 and/or hinge adapter 44. The hinge adapter 44 may be a ported adapter including built in hydraulic fluid flowpaths for directing hydraulic fluid to the hinge 46. In some embodiments, the hinge adapter 44 may form part of a hydraulic fluid manifold. The hinge 46 is generally coupled to the bonnet door 20, and the hinge 46 may include hydraulic fluid flowpaths for routing hydraulic fluid between the flowpaths of the hinge adapter 44 and/or pin 43 and the flowpaths formed in the bonnet door 20. In this manner, each hinge 46 helps to route hydraulic fluid to the corresponding bonnet assembly 16 to actuate the piston(s) of the ram unit 14.

The hinge 46, being coupled to the bonnet door 20, allows the bonnet door 20 to rotate about the hinge axis when the bonnet door 20 is not directly coupled to the body 12 (e.g., via bolts 24). This enables the bonnet door 20 (and entire bonnet assembly 16) to swing away from the body 12 of the blowout preventer after removal of the bolts 24. By hinging the bonnet assembly 16 to the body 12 in this manner, the system allows relatively easy access to the internal components of the bonnet assembly 16 when maintenance or reconfiguration of the one or more cylinder/piston assemblies (e.g., 26, 28, 34, 36) is desired.

As described in detail below, the hinge 46 may be selectively separable from the bonnet door 20, allowing the hinge 46 to be removed from the bonnet door 20 while the bonnet door 20 remains coupled to the body 12 (e.g., via bolts 24). This may enhance the serviceability of various components of the blowout preventer 10. In addition, constructing the hinge 46 as a separate piece from the bonnet door 20 may improve the manufacturing process and reduce the costs for replacing worn components on the blowout preventer 10.

Figure 2A:
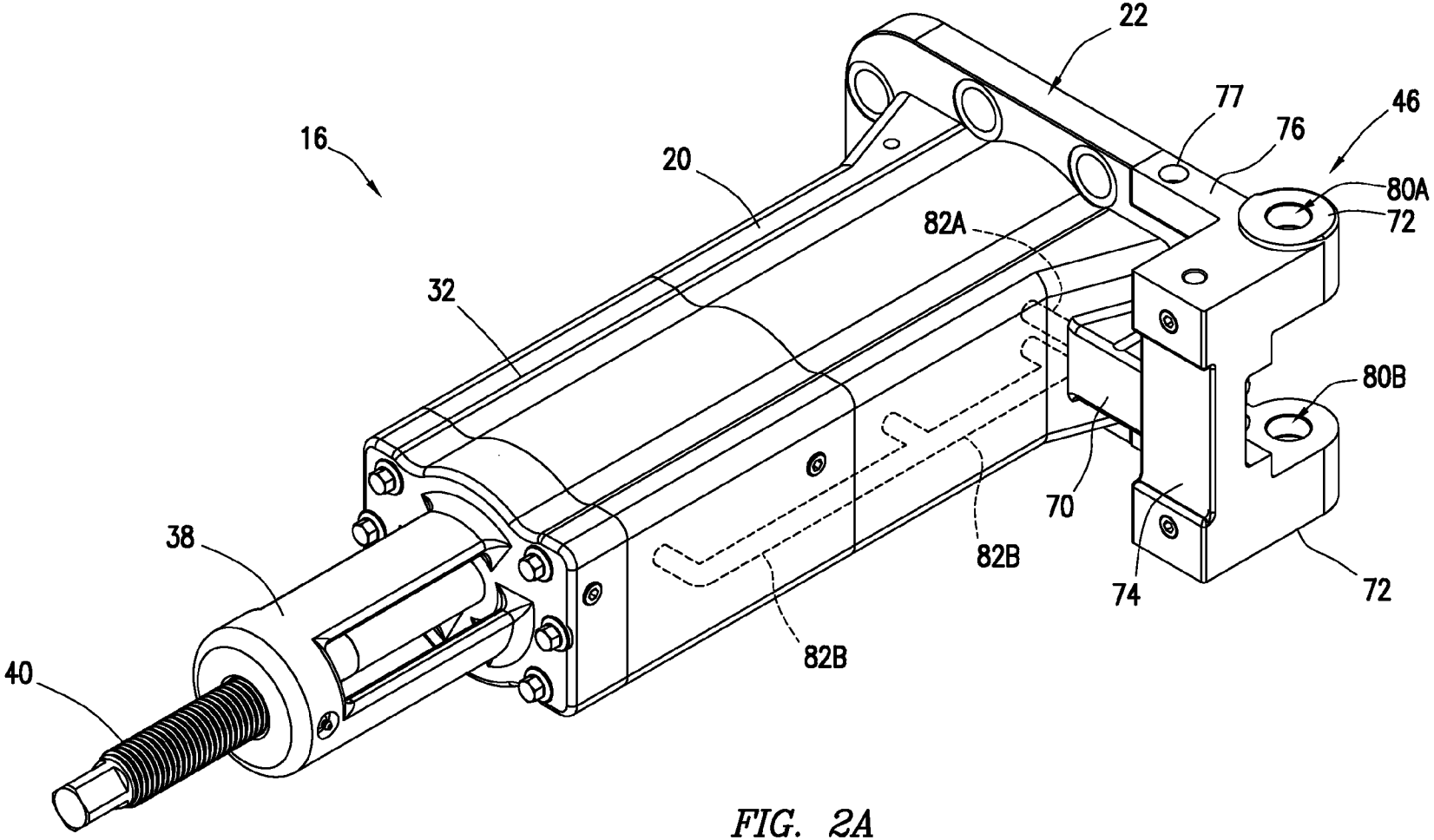
FIGS. 2A and 2B are perspective and side views of a bonnet assembly for use in a blowout preventer, in accordance with an embodiment of the present disclosure.
Figure 2B:
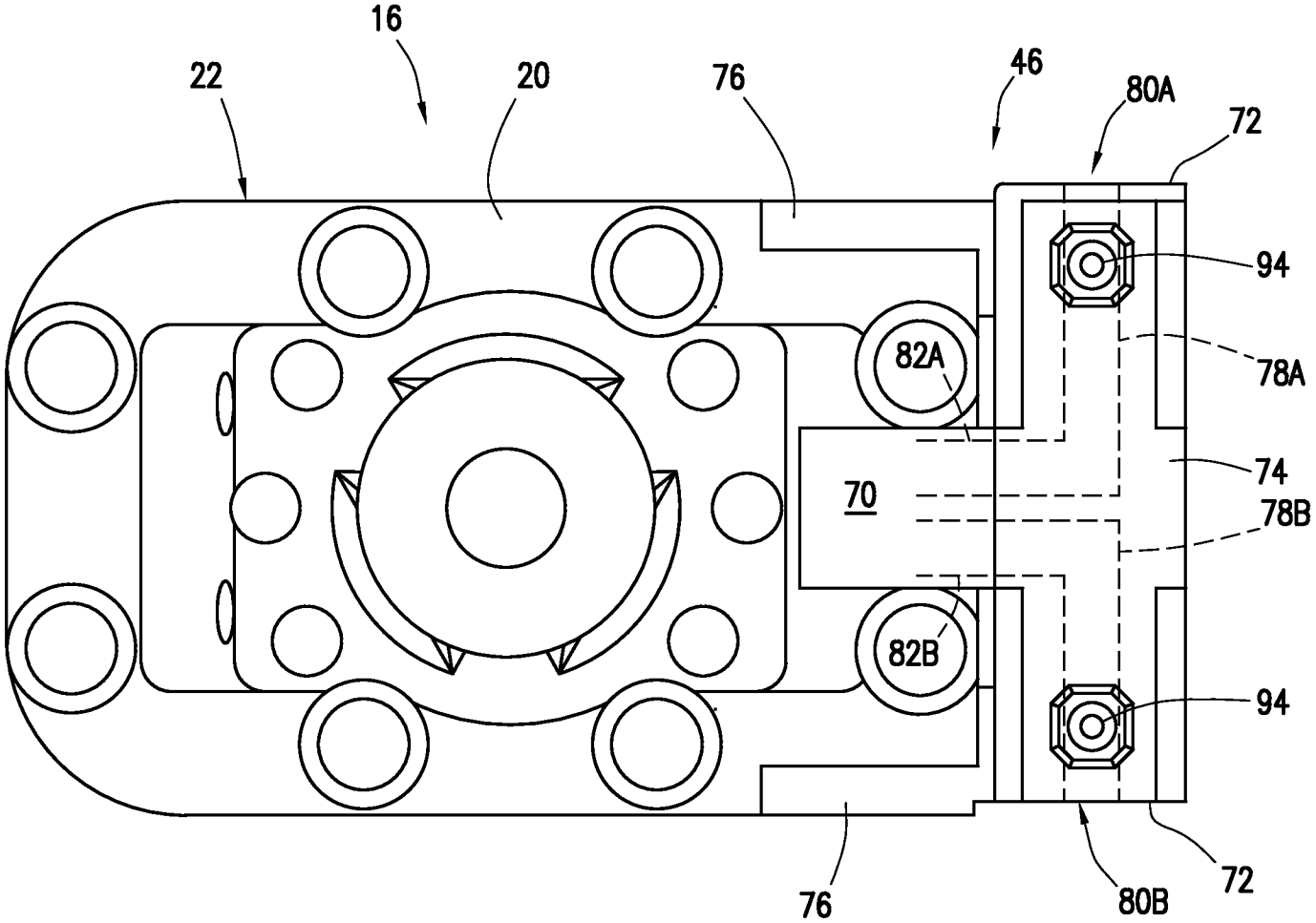

FIGS. 2A and 2B illustrate an embodiment of the bonnet assembly 16 having the hinge 46. The bonnet assembly 16 functions as a shear operator for the blowout preventer. That is, the bonnet assembly 16 connects to the ram shear blade and uses hydraulic fluid to apply a mechanical force to move the shear blade into shearing engagement with an opposed shear blade of the blowout preventer. In the illustrated embodiment, the bonnet assembly 16 may include the bonnet door 20 (with the operating piston/shaft and cylinder liner contained therein) and the booster cylinder 32 (with the booster piston and shaft container therein). In other embodiments, the bonnet assembly 16 may include just the bonnet door 20 with the operating cylinder/piston assembly housed therein. The bonnet assembly 16 may include the end cap 38, which is designed to be disposed over a replaceable tool end of the bonnet assembly 16. That is, the end cap 38 is a specially profiled end piece that is removable from the booster cylinder 32 and/or the bonnet door 20 and can be used on differently configured ram unit operators.

As mentioned above, the hinge 46 is an entirely separate piece from the bonnet door 20, and the hinge 46 can be removably coupled to the bonnet door 20. That is, the hinge is not integral with the bonnet door, as is the case in many existing blowout preventers.

In the illustrated embodiment, the hinge 46 may include two ported hinge connection portions 72, a main body 74, and two arms 76 extending in a transverse direction from the main body 74. The hinge 46 may connect to the hinge adapter/pin described above via the hinge connection portions 72. As shown, the hinge 46 may be coupled to the bonnet door 20 at the arms 76 and/or the main body 74. For example, as shown in FIG. 2A, the hinge 46 may be removably coupled to the bonnet door 20 via one or more fastening mechanisms 77 (e.g., bolts) disposed through the arms 76 and the flanged portion 22 of the bonnet door 20. The arms 76 may be sized to fit into cutouts formed in a complementary shape through the flanged portion 22 of the bonnet door 20.

The hinge 46 may include fluid flowpaths built into the main body 74 of the hinge 46 to route hydraulic fluid to and/or from the various piston chambers within the bonnet assembly 16. For example, the hinge 46 may include a first flowpath 78A extending from a ported hinge connection opening 80A in one of the hinge connection portions 72 to a connector part of the main body 74 designed to abut the bonnet door 20. Similarly, the hinge 46 may include a second flowpath 78B extending from a ported hinge connection opening 80B in the other hinge connection portion 72 to the connector part of the main body 74 designed to abut the bonnet door 20.

This connector part of the main body 74 is designed to abut a flowpath connector portion 70 of the bonnet door 20. The flowpath connector portion 70 may extend laterally from the rest of the bonnet door 20 to connect flowpaths 82A and 82B formed through the bonnet door 20 with the corresponding flowpaths 78A and 78B formed through the hinge 46. The connected flowpaths 78A and 82A enable routing of hydraulic fluid to or from a first side of the one or more piston chambers disposed in the bonnet assembly 16 via the hinge 46. The connected flowpaths 78B and 82B enable routing of hydraulic fluid to or from the opposing second side of the one or more piston chambers disposed in the bonnet assembly 16 via the hinge 46.

Figure 3A:
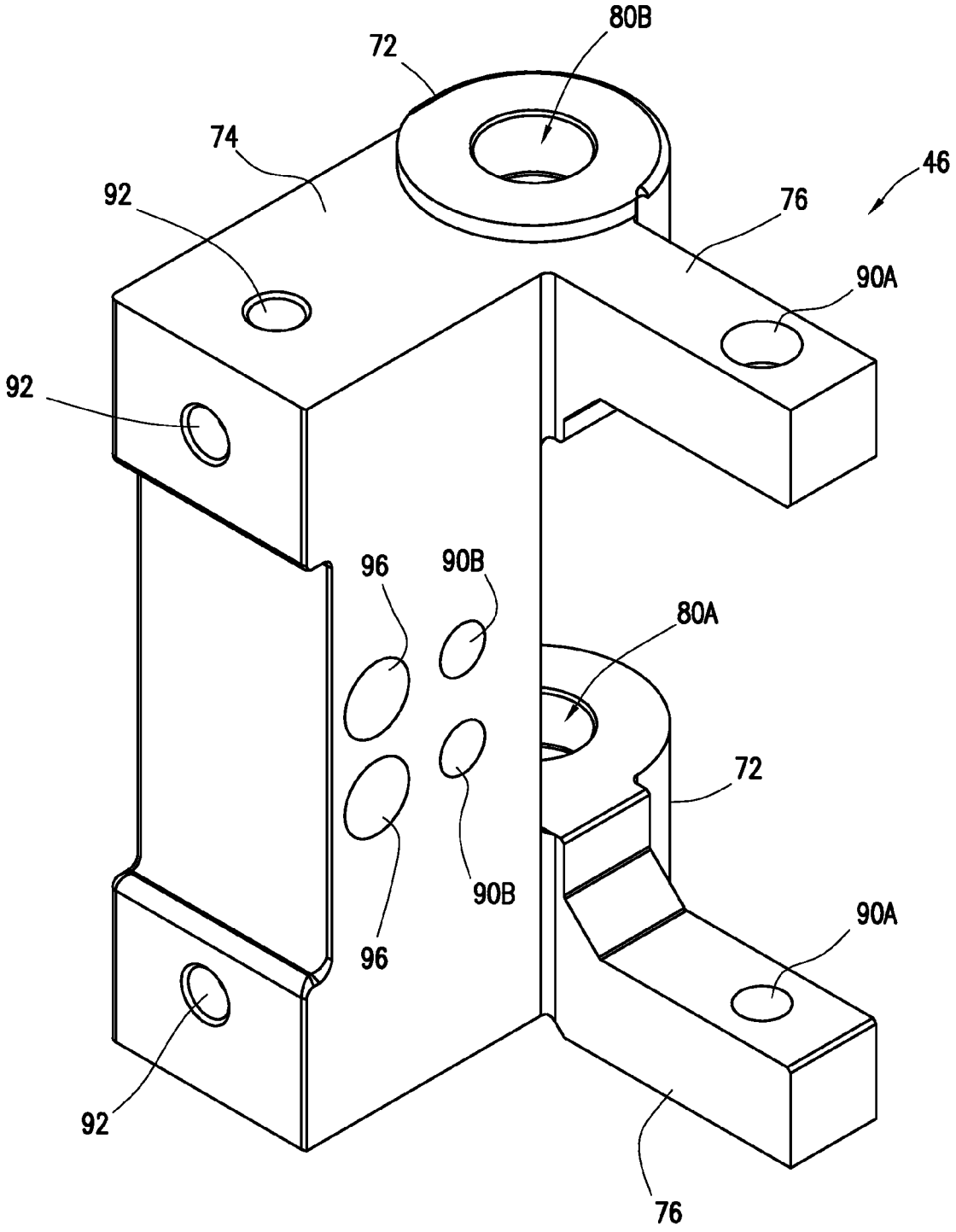
FIGS. 3A-3C are perspective and cross sectional views of a hinge for use in a bonnet assembly, in accordance with an embodiment of the present disclosure.
Figure 3B:
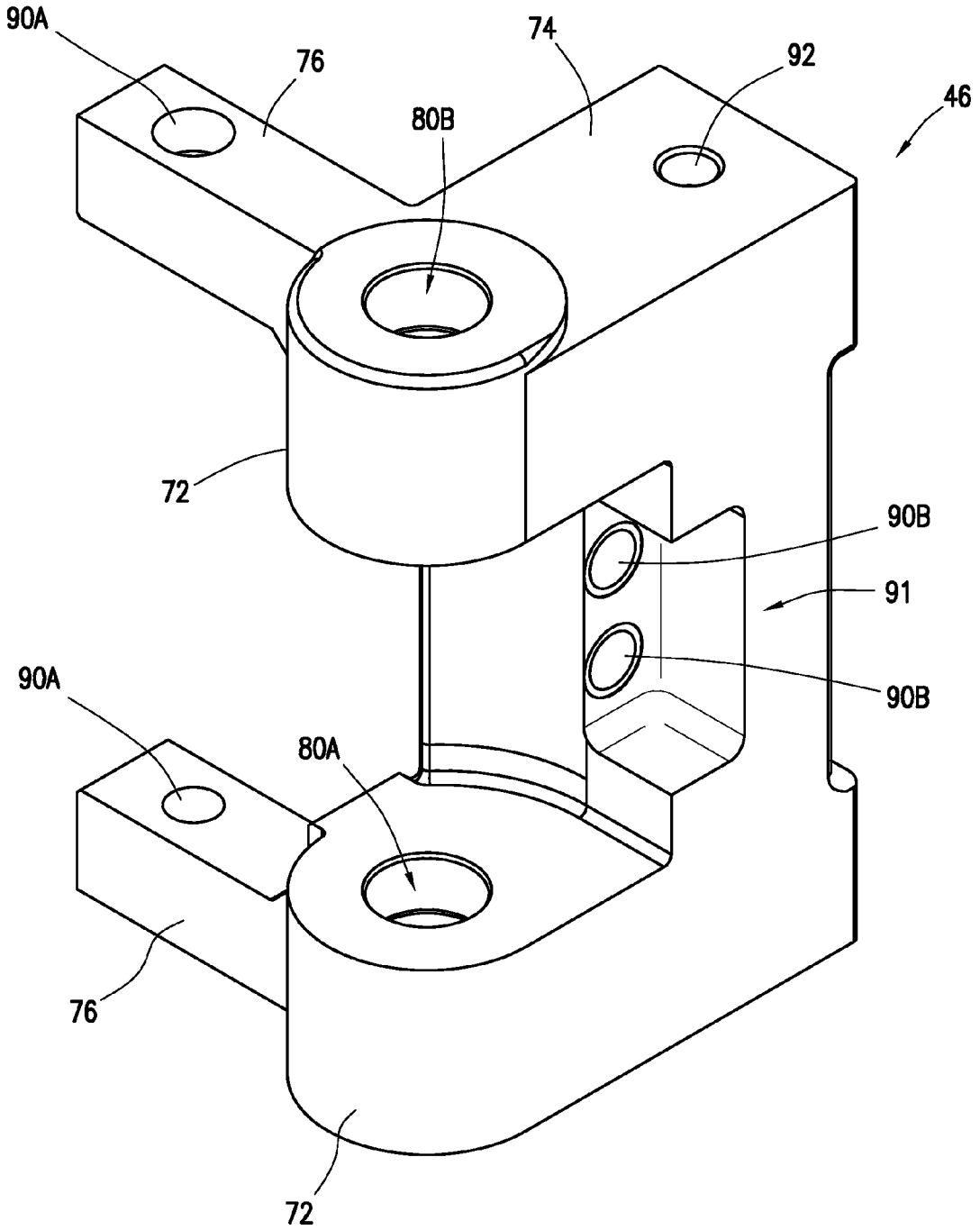
Figure 3C:
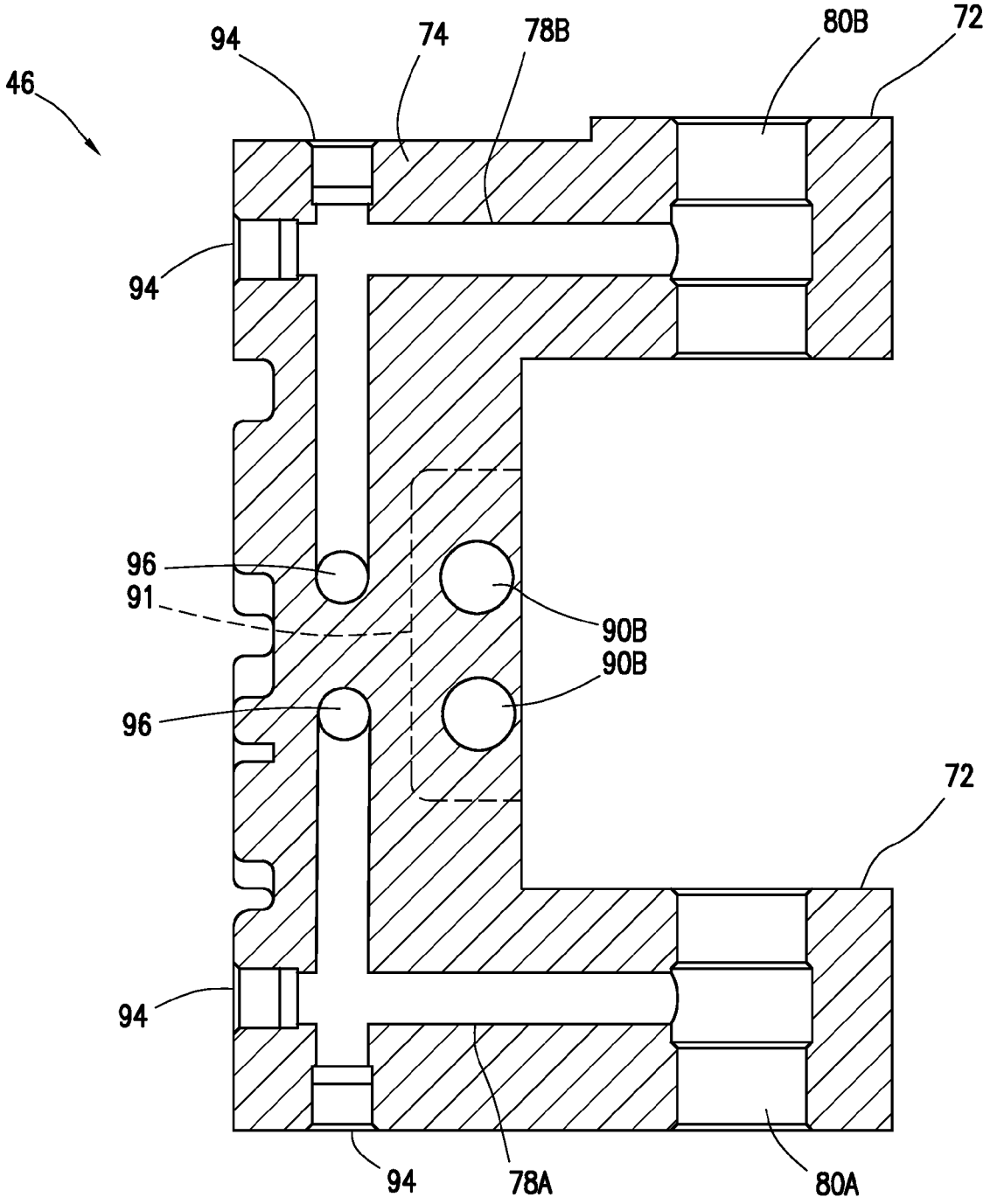

FIGS. 3A-3C provide more detailed views of the hinge 46 that may be removably coupled to the bonnet door of the blowout preventer. The hinge 46 may be coupled to the bonnet door 20 via any desirable type of fastening mechanism including, but not limited to, a bolt, screw, lock pin, or clamp. In some embodiments, the hinge 46 may include apertures 90 formed therethrough in a number of places for receiving a bolt, lock pin, or screw-type fastener configured to be disposed through the hinge 46 and into the bonnet door 20.

In the illustrated embodiment, for example, the hinge 46 may include two apertures 90A (one disposed through each of the arms 76) and another two apertures 90B disposed through the main body 74. The apertures 90A through the arms 76 enable fastening mechanisms to be disposed vertically through the arms 76 of the hinge 46 to couple the hinge 46 to the flanged portion of the bonnet door. At the same time, the apertures 90B through the main body 74 enable fastening mechanisms to be disposed horizontally through the main body 74 and into the flowpath connector portion of the bonnet door. Thus, the apertures 90A and 90B are generally oriented to facilitate coupling the hinge 46 to the bonnet door via fastening mechanisms disposed through the components in two orthogonal directions. This may facilitate a relatively stable connection, and keep the fluid flowpaths through the hinge 46 and the bonnet door properly aligned with each other.

As shown in FIG. 3B, the hinge 46 may feature a cutout 91 formed through the main body 74 to facilitate access to the apertures 90B formed through the main body 74 of the hinge 46. The cutout 91 may provide a relatively thinner portion of the main body 74 through which the fastening mechanisms can be disposed to effectively couple the hinge 46 to the bonnet door.

As shown in FIGS. 3A-3C, the flowpaths 78A and 78B may be formed through the hinge 46 as intersecting channels that are machined into the hinge 46 from different directions. Each of the channels may be drilled through from an outer edge of the hinge 46, and the apertures 92 left at the outer edges may be closed with plugs 94, as shown in FIG. 3C. This machining and plugging process is generally easy to implement during manufacturing. The intersecting channels are used to form the flowpaths 78 leading from the hinge connection openings 80 to two ports 96 formed at an outer edge of the main body 74. These ports 96 are designed to interface with similar ports formed along the outer edge of the bonnet door connector portion to connect the flowpaths 78 in the hinge 46 with the bonnet flowpaths.

Figure 4:
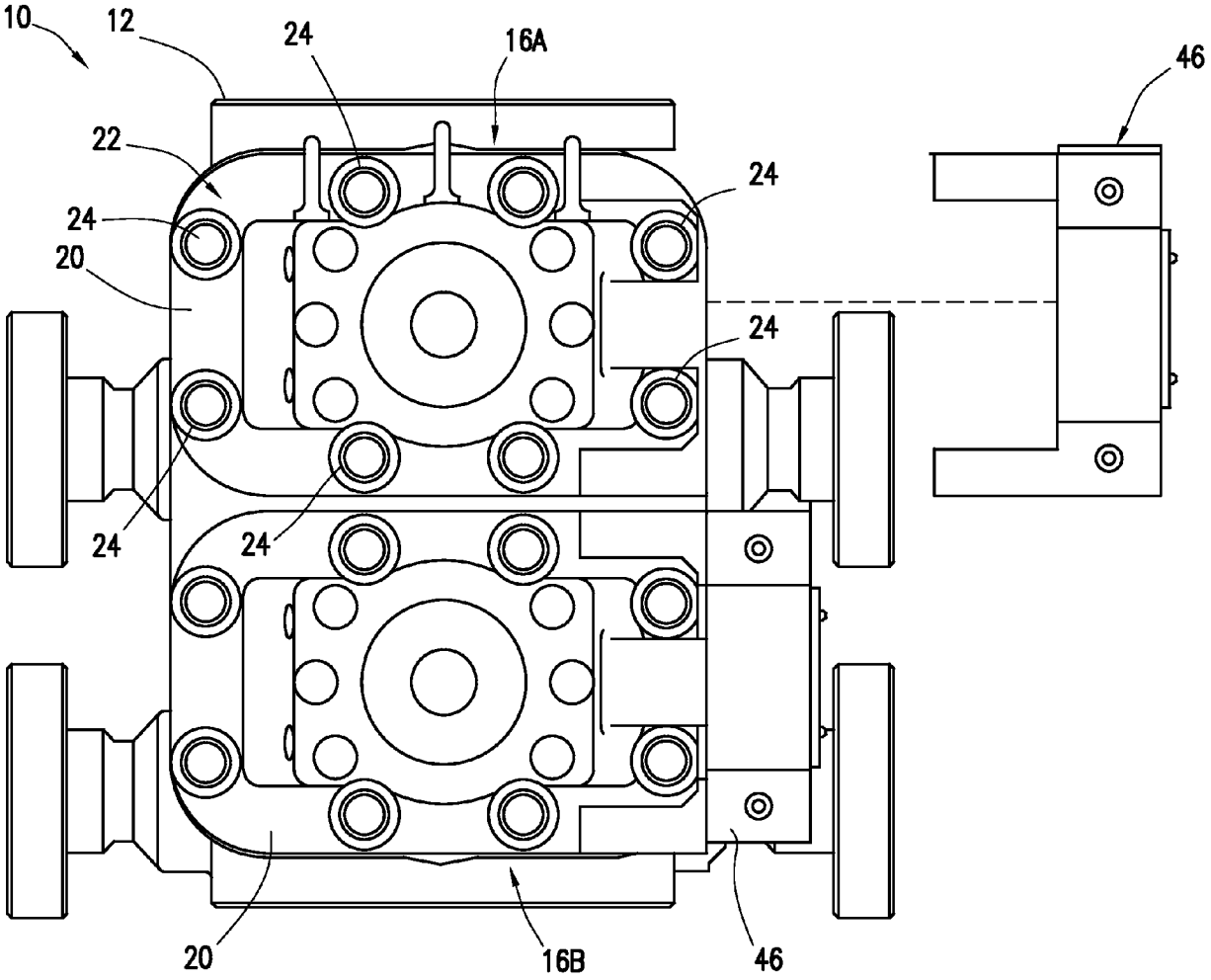
FIG. 4 is a schematic diagram illustrating a hinge of a bonnet assembly being removed from a bonnet door, in accordance with an embodiment of the present disclosure.

Again, the hinge 46 is selectively separable from the bonnet door 20, as shown in FIG. 4. FIG. 4 illustrates the blowout preventer having two bonnet assemblies 16 stacked one over the other, with the hinge 46 corresponding to the upper bonnet assembly 16A being removed from the assembly 16A. As shown, the hinge 46 is designed to be selectively separated from the bonnet door 20 even while the bonnet door 20 is fully coupled to the body 12 of the blowout preventer 10. That is, the flanged portion 22 of the bonnet door 20 may remain coupled to the body 12 via the bolts 24 while the hinge 46 is being removed.

Removing the hinge 46 from the bonnet door 20 may involve loosening or removing the fastening mechanisms used to couple the hinge 46 to the bonnet door 20. The removal process may also involve removing the hinge adapter and/or pin from the body 12 along with the hinge 46. Once the hinge 46 is removed, the hinge 46 may be replaced, repaired, inspected, and/or cleaned as desired.

The removable hinge 46 allows for improved serviceability of the blowout preventer 10. For example, if the hinge 46 becomes damaged while the blowout preventer 10 is moved about a well site or in response to unintentional impact from another piece of well equipment, the hinge 46 itself may be field replaceable. As shown, the hinge 46 may generally stick out further from the body 12 than the other components of the blowout preventer 10, making it more likely to be impacted. A damaged hinge 46 may be replaced without the entire bonnet door 20 or bonnet assembly 16 needing to be replaced. This reduces the cost and weight of replacement parts for portions of the blowout preventer 10 that are more likely to be damaged in the field. In addition, replacing just the hinge 46 takes less time than replacing a combined hinge and bonnet door, since the separate bonnet door 20 does not have to be removed from the body 12 by removing a large number of bolts 24.

The removable hinge 46 also makes the blowout preventer 10 more maintenance friendly than blowout preventers that have a hinge fully integrated with the bonnet door. Specifically, the separable hinge 46 enables an operator to more easily access the flowpaths of the hinge 46 and the flowpaths formed within the bonnet door 20. That way, if trash, debris, or cuttings get into the hydraulic fluid pathways of the blowout preventer 10, an operator may more easily access the hinge 46 and/or bonnet door 20 to clean out the fluid pathways.

In addition, the separate hinge 46 and bonnet door 20 components may be relatively easier to manufacture separately than as integral components. For example, the fluid pathways through the hinge 46 and the bonnet door 20 may be formed by drilling fewer channels into the components. In addition, by manufacturing these components separately, an operator may be able to design a more effective or differently shaped hinge 46 than would be available if the hinge and bonnet were constructed as one piece.

Figure 5:
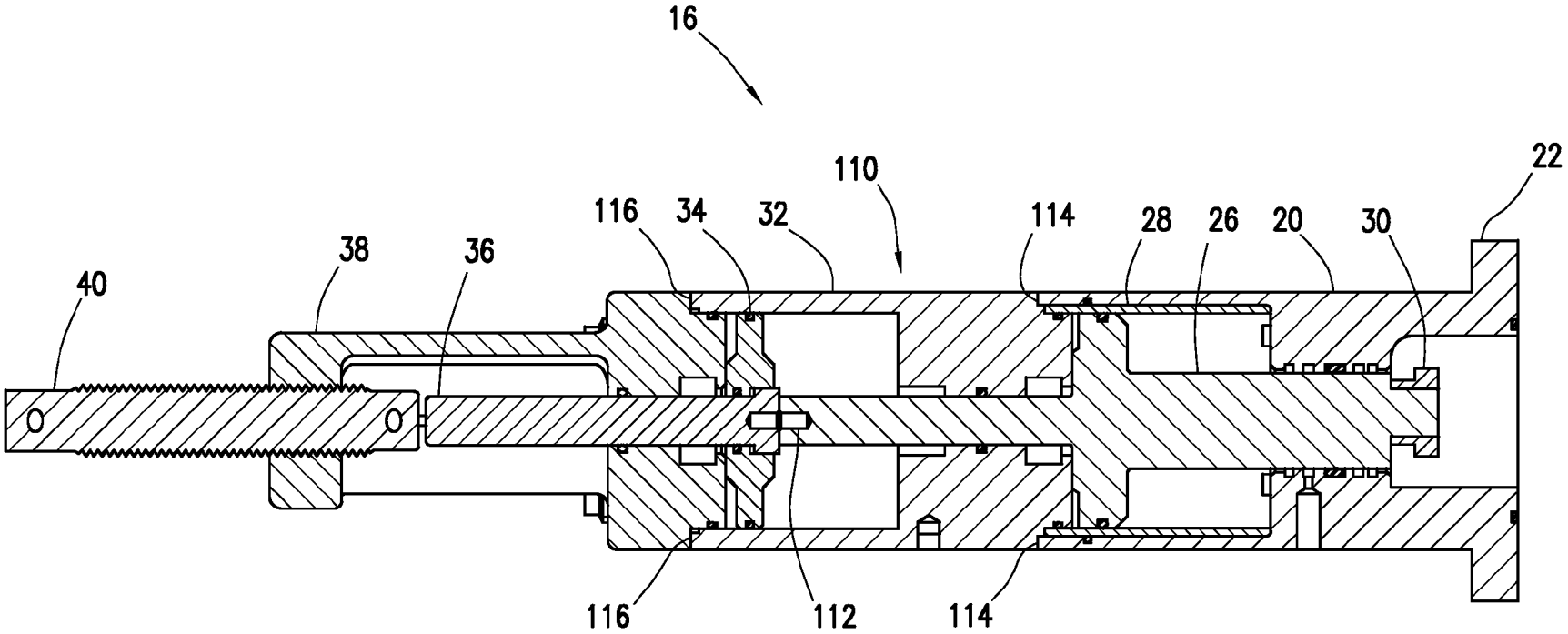
FIG. 5 is a cross sectional view of a bonnet assembly having a booster cylinder disposed therein, in accordance with an embodiment of the present disclosure.

FIG. 5 illustrates a cross section of an embodiment of the bonnet assembly 16 described herein. The illustrated bonnet assembly 16 is similar to the upper bonnet assembly 16A described above with reference to FIG. 1. That is, the bonnet assembly 16 may generally include a first cylinder (operating cylinder) disposed in the bonnet door 20 and a second separate cylinder (booster cylinder 32) coupled thereto. The booster cylinder 32 may be added to the end of the operating cylinder to provide additional mechanical power for driving the shear rams to shear a relatively large diameter pipe.

As illustrated, the booster cylinder 32 may be incorporated into the bonnet 16 as an add-on assembly 110. The add-on assembly 110 may include the booster cylinder 32, the booster shaft 36, the booster piston 34, and a fastening mechanism 112 for coupling the booster shaft 36 to the operating piston 26. The add-on assembly 110 may be used to retro-fit existing bonnet assemblies that only feature a single operating cylinder. To that end, the add-on assembly 110 may be shaped to fit onto a specific interface pattern 114 of the first operating cylinder (e.g., bonnet door 20 and cylinder liner 28), thereby enabling the booster add-on assembly 110 to be coupled to the back end of the bonnet door 20. In addition, the add-on assembly 110 may include an interface pattern 116 at its back end that matches the interface pattern 114 of the first operating cylinder. This allows the add-on assembly 110 to interface with the existing end cap 38. The same end cap 38 may therefore be used with both a single cylinder bonnet assembly as well as the bonnet assembly 16 with the booster cylinder add-on assembly 110.

Although the present invention and its advantages have been described in detail, it should be understood that various changes, substitutions and alternations can be made herein without departing from the spirit and scope of the invention as defined by the following claims.

What is claimed is:

1. A blowout preventer, comprising:

a body defining intersecting horizontal and vertical passageways extending through the body, wherein the horizontal passageway forms a ram location;

a bonnet comprising:

a ram unit capable of seating in the ram location of the body; and a bonnet door removably coupled to a first side of the body, wherein the bonnet door comprises a flanged portion for coupling the bonnet to the body;

a pin or hinge adapter disposed along the body and defining a hinge axis;

a hinge rotatably coupled to the pin or hinge adapter, wherein the hinge is coupled to the bonnet door to rotate the bonnet about the hinge axis;

wherein the hinge and the bonnet door are selectively separable;

wherein the hinge comprises a body portion with two flowpaths formed therethrough, and two arms extending in a transverse direction away from the body for removably coupling the hinge to opposite sides of the flanged portion of the bonnet door; and one or more fastening mechanisms positioned vertically through each of the arms and into the flanged portion of the bonnet door, and one or more fastening mechanisms positioned horizontally through the body portion of the hinge and into the bonnet door.

2. The blowout preventer of claim 1, wherein the hinge is configured to be selectively removed from the bonnet door while the bonnet door is bolted to the first side of the body.

3. The blowout preventer of claim 1, wherein the bonnet door comprises a flowpath connector portion extending toward the hinge for interfacing with the hinge such that ports defining the ends of two flowpaths formed through the hinge are aligned with ports defining the ends of two flowpaths formed through the bonnet door.

4. The blowout preventer of claim 1, wherein the pin or hinge adapter comprises two flowpaths for routing hydraulic fluid to and from the hinge and the bonnet.

5. The blowout preventer of claim 1, wherein the ram unit of the bonnet comprises an operating cylinder assembly and a booster cylinder assembly for actuating the ram unit.

6. The blowout preventer of claim 5, wherein the booster cylinder assembly comprises an add-on assembly having an interface pattern that matches an interface pattern of the operating cylinder assembly.

7. A system, comprising:

a bonnet door comprising a flanged portion for removably coupling a bonnet having the bonnet door to a body of a blowout preventer;

a hinge coupled to the bonnet door for rotating the bonnet about a hinge axis relative to a pin or hinge adapter disposed along the body, wherein the hinge and the bonnet door are selectively separable while the bonnet door is coupled to the body of the blowout preventer;

wherein the hinge comprises a body portion with two flowpaths formed therethrough, and two arms extending in a transverse direction away from the body for removably coupling the hinge to opposite sides of the flanged portion of the bonnet door; and one or more fastening mechanisms positioned vertically through each of the arms and into the flanged portion of the bonnet door, and one or more fastening mechanisms positioned horizontally through the body portion of the hinge and into the bonnet door.

8. The system of claim 7, wherein the hinge is selectively separable from the bonnet door and replaceable with another hinge while the bonnet door remains coupled to the body.

9. The system of claim 7, wherein the hinge is coupled to the bonnet door via a plurality of removable fastening mechanisms.

10. The system of claim 7, wherein the bonnet door comprises a flowpath connector portion extending toward the hinge for interfacing with the hinge such that ports defining the ends of two flowpaths formed through the hinge are aligned with ports defining the ends of two flowpaths formed through the bonnet door.

11. A method, comprising:

routing hydraulic fluid from a hinge of a blowout preventer into a bonnet door that is bolted to a body of the blowout preventer and coupled to the hinge;

routing the hydraulic fluid through flowpaths in the bonnet door to actuate a cylinder disposed in a bonnet having the bonnet door;

removing a first fastener from a first position vertically extending through a first arm of the hinge and a first side of a flanged portion of the bonnet door;

removing a second fastener from a position extending vertically through a second arm of the hinge and a second side of the flanged portion; and removing a third fastener from a position extending horizontally through a body portion of the hinge and the bonnet door; and selectively removing the hinge from the bonnet door while the bonnet door remains bolted to the body of the blowout preventer.

12. The method of claim 11, further comprising replacing the hinge with another hinge for routing hydraulic fluid.

13. The method of claim 11, further comprising routing hydraulic fluid from a pin or hinge adapter disposed along the body of the blowout preventer into the hinge.

14. The method of claim 11, further comprising actuating a first cylinder disposed in the bonnet and a booster cylinder disposed in the bonnet via the hydraulic fluid.

* * * * *